United States Patent [19]

Purdy

[11] Patent Number: 4,951,180

[45] Date of Patent: Aug. 21, 1990

[54] LAMP REFLECTORS

[75] Inventor: Geoffrey W. Purdy, Hyde, England

[73] Assignee: Oldham Crompton Batteries, Stockport, England

[21] Appl. No.: 302,880

[22] Filed: Jan. 30, 1989

[30] Foreign Application Priority Data

Jan. 28, 1988 [GB] United Kingdom ..... 8801883

[51] Int. Cl.[5] ..... F21V 7/06

[52] U.S. Cl. ..... 362/106; 362/346; 362/350; 2/209.2

[58] Field of Search ..... 362/296, 346, 341, 347, 362/350, 106, 184, 208; 2/209.2

[56] References Cited

U.S. PATENT DOCUMENTS

| | | | |
|---|---|---|---|
| 3,553,705 | 1/1971 | Ondreska | 362/347 |
| 3,944,810 | 3/1976 | Grindle | 362/350 |
| 4,420,801 | 12/1983 | Reiling et al. | 362/347 |
| 4,536,834 | 8/1985 | Sands et al. | 362/347 |

*Primary Examiner*—Ira S. Lazarus
*Assistant Examiner*—Richard R. Cole
*Attorney, Agent, or Firm*—Sughrue, Mion, Zinn, Macpeak & Seas

[57] ABSTRACT

A miner's cap lamp includes a reflector having a substantially parabolic reflecting surface having a gradient variation from that of a true parabola curve $Y^2=4MX$ along at least one line towards the outer edge of the reflector, wherein the gradient along the line has a value equal to that of a true parabola at the maximum value of X for the reflector but has a value greater than the gradient of a parabolic surface for a modified region located nearer the pole of the curve, the gradient variation varying continuously over the modified region, such that the gradient variation is a minimum at the maximum value of X of the modified region and the gradient variation is a maximum at the minimum value of X of the modified region.

13 Claims, 1 Drawing Sheet

LAMP REFLECTORS

The present invention relates to a reflector for use in a lamp. The invention is particularly applicable to a miner's cap lamp but it may be used for a variety of lamps where control of the beam is required.

BACKGROUND OF THE INVENTION

It is known to provide parabolic reflectors for various electric lamps including miners' cap lamps in which the filament of an electric bulb is placed at the focus of a parabolic reflector. Such an arrangement produces a parallel beam of light but as the filament extends beyond the point of the focus of the parabola, there is a slight spread of light around the parallel beam. The disadvantage of this kind of reflector is that at distances of up to 3 meters only a relatively small spot of light is produced and for some applications such as in a miner's cap lamp, this provides a limited area of illumination at the distance of normal operation by the user. The human eye can usually see clearly without moving within an angular spread of about 6° i.e. about 3° on either side of the axis of the eye.

An aim of the present invention is to provide an improved reflector which produces a controlled spread of light which is larger than that of a corresponding parabolic reflector and suited to the requirements of the user.

SUMMARY OF THE INVENTION

The present invention provides a lamp reflector having a substantially parabolic reflecting surface wherein the curvature of the reflecting surface has a gradient variation from that of a true parabola curve $Y^2=4MX$ along at least one line towards the outer edge of the reflector, wherein the gradient along said line has a value equal to that of a true parabola at the maximum value of X for the reflector but has a value greater than the gradient of a parabolic surface for a modified region located nearer the pole of the curve, the said gradient variation varying continuously over said modified region, such that the said gradient variation is a minimum at the maximum value of X of the modified region and the said gradient variation is a maximum at the minimum value of X of the modified region.

Preferably the gradient variation from the that of a parabola varies substantially linearly with change of X value in the modified region.

In a preferred embodiment the angle of inclination of a tangent to the reflector $\theta$ modified is given by the equation $$\theta modified = \theta parabola + A - BX$$

wherein $\theta$ parabola is the angle of inclination of a tangent to a parabola.

The gradient variation from that of a parabola may be provided on one side of the axis only or it may be provided symmetrically on opposite sides of the axis of the reflector.

If the spread of light is required in selected directions only then the modification in shape may occur in selected planes only. Alternatively the gradient may be modified from that of a parabola in all planes in which the axis of the reflector lies.

The invention also provides a battery operated lamp having a reflector as aforesaid and an electrical bulb located within the reflector with a filament at the focus of the parabolic curve.

The invention also provides a miner's cap lamp comprising a lamp body for attachment to a protective helmet, a reflector as aforesaid and an electric bulb positioned to provide a light source at the focus of the reflector.

Preferably the reflector has an aperture located substantially at its pole through which a light bulb is inserted. Preferably the said modified region of the reflector extends to the reflecting region nearest the pole of the reflector which receives incident light from the light source. Preferably the spread of light reflected lies within the range of 0° to 5°, and preferably 0° to 3°, on either side of the axis of the reflector.

In a preferred construction of cap lamp two main beam sources are provided one comprising a parabolic reflector and the other comprising a modified parabolic reflector as aforesaid.

Preferably the two reflectors are mounted side by side in a cap lamp housing so as to reduce the overall height of the lamp.

Preferably the two reflectors are of similar dimensions and have a similar power output.

Figure 1:
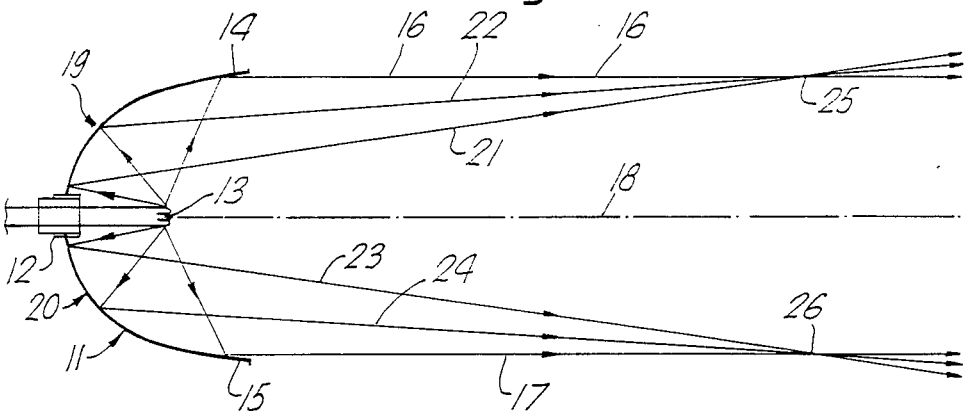
FIG. 1 is a ray diagram for one example of a reflector according to the present invention.

In this embodiment a lamp reflector 11 incorporating the invention is of modified parabolic shape. A central aperture 12 is provided at the pole of the reflector and an electric bulb having a filament 13 is inserted through the aperture so that the filament lies adjacent the focus of part of the reflector which is of parabolic form. The outer edges 14 and 15 of the reflector are of true parabolic form following the normal formula $Y^2=4MX$ for a parabola. In this way, light which leaves the filament 13 and is incident on the outer regions 14 and 15 is directed along paths 16 and 17 parallel to an axis 18 of the parabola thereby forming a parallel light beam. However, a region 19 between the outer edge 14 and the pole 12, and a similar region 20 on the other side of the axis 18 forms a modified reflector region wherein the curvature deviates from that of a normal parabola. In these modified regions 19 and 20 the gradient of the curve is greater than that of a normal parabola and the gradient variation from that of a normal parabola is caused to vary continuously over the modified regions 19 and 20 with the greatest increase in gradient compared with a parabola occurring in the modified regions 19 and 20 nearest the central aperture 12 and the variation being least in the outer regions approaching the parabolic regions 14 and 15. The modified regions 19 and 20 extend up to the parts of the reflector nearest the central aperture 12 which are able to receive incident light from the filament 13. As can be seen from rays 21, 22, 23 and 24, light which is reflected by the modified reflecting regions 19 and 20 is caused to diverge outwardly thereby giving an increased spread in illumination at distances greater than the points marked 25 and 26 where the diverging beams intersect the parallel beams 16 and 17. The extent to which the light beam spreads beyond the points 25 and 26 can be controlled by the extent of modification of the curvature of the modified regions 19 and 20 depending on the requirements of the user. In the particular example shown, the light forming beams 21 and 23 which has been incident the part of the reflector closest to the central aperture 12 has the greatest outward deviation as it has been reflected by the part of the modified reflector having the greatest increase in gradient relative to that of a true parabola. Beams 22 and 24 have an outward deviation to a lesser extent.

The diagram in FIG. 1 has been exaggerated for the sake of clarity and in this particular example the extent of deviation caused by the modified reflector shape is 3° on either side of the axis 18 thereby giving a 6° spread. The invention is particularly applicable for use in a miner's cap lamp of the type illustrated in FIG. 2 and in that case the spread of light may be within the range 0° to 5° on either side of the axis giving a total spread of 10°.

FIG. 1 does of course show the position on a single plane in which the axis of the reflector lies. In the example illustrated the modification of curvature is symmetrical on opposite sides of the axis of the reflector so that the modified curvature regions 19 and 20 each have the same modified shape. Furthermore, in a preferred example the modification shown in regions 19 and 20 is similar in all planes in which the axis of the reflector lies so that a symmetrical spread of light is achieved in all directions around the axis 18. It may however be desirable in some cases to provide a modified shape in a single plane only or to provide different extents of modification in different planes. Furthermore it may in some cases be desirable to provide modified shape on only one side of the axis so that a spread is achieved in one direction away from the axis without a corresponding spread on the other side.

In the example shown in FIG. 1 the parabolic part of the reflector may be defined by the equation $$Y^2=4MX$$

The angle of inclination of a tangent to such a curve may be defined as 0 parabola and the angle of inclination of the tangent to the modified regions 19 and 20 may be defined as $\theta$ modified. In one preferred arrangement $$\theta modified=\theta parabola+A-BX.$$

In this way a continuous variation in gradient modification is achieved between a lower limit of X and an upper limit of X and the gradient variation is linear with change of X value. In an alternative arrangement, a different light distribution is achieved by using the modification:

$$\theta \text{ modified} = \theta \text{ parabola} + \frac{b}{\sqrt{x}} - a$$

The gradient of the two modified curves can alternatively be represented by $$\frac{dy}{dx} = \tan\left[\left(\text{ARC TAN}\frac{\sqrt{m}}{\sqrt{x}}\right) + a - bx\right]$$

and

-continued $$\frac{dy}{dx} = \tan\left[\left(\text{arc tan}\frac{\sqrt{m}}{\sqrt{x}}\right) + \frac{b}{\sqrt{x}} - a\right]$$

These equations can be used to calculate the precise shape of curve required to obtain any particular spread of light reflected by the modified region.

Although the improved reflector shown in FIG. 1 is particularly suited for use in a miner's cap lamp, it may be used in other lamps where a controlled spread in one or more directions is required.

Figure 2:
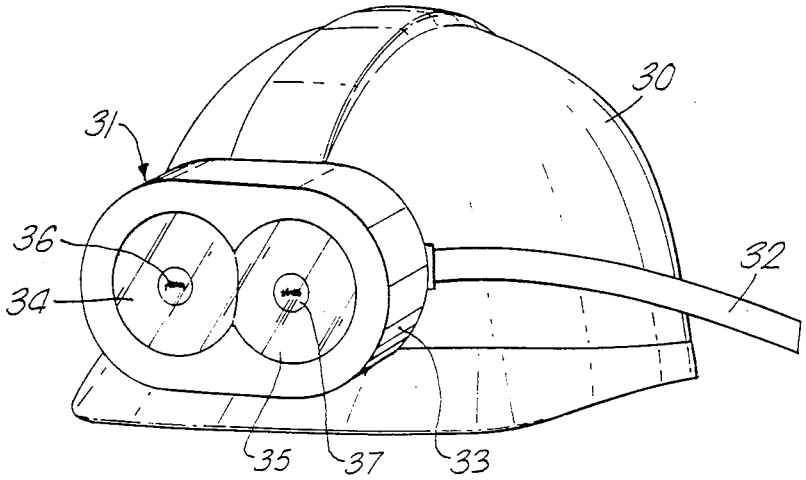
FIG. 2 shows a miner's cap lamp incorporating one example of a reflector in accordance with the present invention in addition to a parabolic reflector.

An application to a miner's cap lamp is shown in FIG. 2. In this example a protective helmet 30 is provided with a cap lamp 31 supplied with electric power through a lead 32 from a battery unit not shown. The cap lamp 31 has a housing 33 in which are located side by side two equal sized reflectors 34 and 35. Each is protected by a similar sized protective glass. The reflector 34 is a true parabolic reflector arranged to give a parallel beam of light whereas reflector 35 is a modified parabolic reflector of the type already described with reference to FIG. 1. This modified reflector is arranged to give a spread of light up to a maximum of 5° on either side of the axis of the reflector and this provides a miner with a reasonable spread of light at a distance of approximately 3 meters which is a common working distance for use with a miner's cap lamp. At that distance the spread is sufficient to enable the miner to have reasonable illumination of an area which may be covered by the human eye without the need to move the direction of the eye axis. In the example of FIG. 2 both lamps form main beams. Each has its own electric bulb 36 and 37. The two beams are arranged to provide the same electrical power output. The two lamps may be connected either in parallel or in series to the power supply. If connected in parallel they may be used together or alternatively if a selector switch is included. If the lamps are connected in series the intensity from each bulb may give a lower light intensity for a longer period. In order to meet necessary safety standards, the glass area for each reflector is less than for lamps having a single reflector so that the total glass area does not exceed the maximum required.

The invention is not limited to the details of the foregoing examples.

What is claimed is:

1. A lamp reflector having a pole, an axis and a substantially parabolic reflecting surface having a curvature extending outwardly from the pole towards an outer edge of the reflector wherein the curvature of the reflecting surface has a gradient variation from that of a true parabola curve $Y_2=4MX$ along at least one line from said pole towards the outer edge of the reflector, wherein the gradient along said line has a value equal to that of a true parabola at a maximum value of X for the reflector but has a value greater than the gradient of a parabolic surface for a modified region located nearer said pole, the said gradient variation varying continuously over said modified region, such that the said gradient variation is a minimum at a maximum value of X of the modified region and a said gradient variation is a maximum at a minimum value of X of the modified region.

2. A reflector according to claim 1 wherein the gradient variation from the that of a parabola varies substantially linearly with change of X value in the modified region.

3. A reflector according to claim 1 wherein the angle of inclination of a tangent to the reflector $\theta$ modified is given by the equation $$\theta modified = \theta parabola + A - BX$$

wherein $\theta$ parabola is the angle of inclination of a tangent to a parabola.

4. A reflector according to claim 1 wherein the gradient variation from that of a parabola is symmetrical on opposite sides of the axis of the reflector.

5. A reflector according to claim 4 wherein the gradient is modified from that of a parabola in all planes in which the axis of the reflector lies.

6. A battery operated lamp having (a) a lamp housing (b) a reflector having a pole, an axis and a substantially parabolic reflecting surface having a curvature extending outwardly from the pole towards an outer edge of the reflector wherein the curvature of the reflecting surface has a gradient variation from that of a true parabola curve $Y^2=4MX$ along at least one line from said pole towards the outer edge of the reflector, wherein the gradient along said line has a value equal to that of a true parabola at a maximum value of X for the reflector but has a value greater than the gradient of a parabolic surface for a modified region located nearer said pole, the said gradient variation varying continuously over said modified region, such that said gradient variation is a minimum at a maximum value of X of the modified region and the said gradient variation is a maximum at a minimum value of X of the modified region and (c) an electrical bulb located within the reflector with a filament at a focus of the parabolic curve.

7. A lamp according to claim 6 in which light reflected by said reflecting surface lies within a range of 0° to 5°, and preferably 0° to 3°, on either side of the axis of the reflector.

8. A miner's cap lamp comprising (a) a lamp body with an attachment device for attachment to a protective helmet, (b) a reflector having a pole, an axis and a substantially parabolic reflecting surface having a curvature extending outwardly from the pole towards an outer edge of the reflector wherein the curvature of the reflecting surface has a gradient variation from that of a true parabola curve $Y^2=4MX$ along at least one line from said pole towards the outer edge of the reflector, wherein the gradient along said line has a value equal to that of a true parabola at a maximum value of X for the reflector but has a value greater than the gradient of a parabolic surface for a modified region located nearer said pole, the said gradient variation varying continuously over said modified region, such that said gradient variation is a minimum at a maximum value of X of the modified region and the said gradient variation is a maximum at a minimum value of X of the modified region and (c) an electric bulb positioned to provide a light source at a focus of the reflector.

9. A cap lamp according to claim 8 wherein the reflector has an aperture located substantially at its pole through which said light bulb is inserted.

10. A cap lamp according to claim 9 wherein the said modified region of the reflector extends to the reflecting region nearest the pole of the reflector which receives incident light from the light source.

11. A cap lamp according to claim 8 further comprising a second reflector having a parabolic curvature.

12. A cap lamp according to claim 11 wherein the two reflectors are mounted side by side in a cap lamp housing so as to reduce the overall height of the lamp.

13. A cap lamp according to claim 11 wherein the two reflectors are of similar dimensions and have a similar power output.

* * * * *